US008037868B2

(12) United States Patent
Kannan et al.

(10) Patent No.: US 8,037,868 B2
(45) Date of Patent: Oct. 18, 2011

(54) IN-LINE NOISE FILTERING DEVICE FOR FUEL SYSTEM

(75) Inventors: Venkatesh Kannan, Novi, MI (US); Michael U. Fischer, Niefern-Oschelbronn (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/083,793

(22) Filed: Apr. 11, 2011

(65) Prior Publication Data

US 2011/0192378 A1 Aug. 11, 2011

Related U.S. Application Data

(62) Division of application No. 12/499,495, filed on Jul. 8, 2009, now Pat. No. 7,942,132.

(60) Provisional application No. 61/081,511, filed on Jul. 17, 2008.

(51) Int. Cl.
*F02M 69/46* (2006.01)
*F02M 61/14* (2006.01)

(52) U.S. Cl. ..... 123/456; 123/467; 123/470

(58) Field of Classification Search ..... 123/456, 123/467, 468, 469, 470
See application file for complete search history.

(56) References Cited

U.S. PATENT DOCUMENTS 4,286,563 A 9/1981 Fahim et al.
4,570,600 A 2/1986 Atkins et al.
4,693,223 A 9/1987 Eshleman et al.
4,811,905 A * 3/1989 Ishikawa et al. ..... 239/575
4,984,548 A 1/1991 Hudson, Jr.
5,301,647 A 4/1994 Lorraine
5,383,606 A 1/1995 Stegmaier et al.
5,417,373 A 5/1995 Facchin
5,575,262 A * 11/1996 Rohde ..... 123/467
5,579,739 A 12/1996 Tuckey et al.
5,749,527 A 5/1998 Fujikawa et al.
5,752,486 A 5/1998 Nakashima et al.
5,769,328 A 6/1998 Zdyb et al.
5,785,022 A 7/1998 Haboush
(Continued)

FOREIGN PATENT DOCUMENTS

DE 3122883 5/1983
(Continued)

OTHER PUBLICATIONS

Porsche Direct Injection Fuel Injector (Part No. 9A1 110 128 00) for the 2009 Porsche 911 Carrera, fuel injector believed to be manufactured for Porsche by Siemens, on sale in the United States as of Sep. 20, 2008. Laser tomography image, relevant page of 2009 Porsche 911 Carrera Parts Manual, and Statement of Relevance attached, 3 pages.

(Continued)

*Primary Examiner* — Thomas Moulis
(74) *Attorney, Agent, or Firm* — Michael Best & Friedrich LLP

(57) ABSTRACT

A fuel injection system includes a fuel supply rail having a supply opening. A fuel injector is coupled to the fuel supply rail and configured to control the delivery of fuel from the fuel supply rail through the supply opening. A noise filtering device engages an upstream end of the fuel injector. The noise filtering device has a projecting portion extending at least partially into the supply opening along an axis, and the noise filtering device defines a restriction passage for directing fuel from the supply rail into the fuel injector. A face seal is established at a transverse face adjacent the supply opening.

18 Claims, 13 Drawing Sheets

U.S. PATENT DOCUMENTS

| | | | | |
|---|---|---|---|---|
| 5,829,688 | A | 11/1998 | Rembold et al. | |
| 5,967,419 | A | 10/1999 | Yamaguchi et al. | |
| 6,102,007 | A * | 8/2000 | Furst | 123/469 |
| 6,264,112 | B1 | 7/2001 | Landschoot et al. | |
| 6,328,232 | B1 | 12/2001 | Haltiner, Jr. et al. | |
| 6,382,532 | B1 | 5/2002 | French et al. | |
| 6,431,151 | B1 | 8/2002 | Gmelin | |
| 6,454,192 | B2 | 9/2002 | Perry | |
| 6,474,572 | B1 | 11/2002 | Tsuchiya et al. | |
| 6,508,232 | B2 | 1/2003 | Sogawa | |
| 6,520,421 | B2 | 2/2003 | Dallmeyer et al. | |
| 6,543,421 | B2 | 4/2003 | Lorraine et al. | |
| 6,565,019 | B2 | 5/2003 | Dallmeyer et al. | |
| 6,604,510 | B2 | 8/2003 | Scollard et al. | |
| 6,615,802 | B2 | 9/2003 | Reiter et al. | |
| 6,629,650 | B2 * | 10/2003 | Curran et al. | 239/585.1 |
| 6,640,784 | B1 | 11/2003 | Sims, Jr. | |
| 6,655,609 | B2 | 12/2003 | Dallmeyer et al. | |
| 6,684,861 | B2 | 2/2004 | Reiter | |
| 6,698,664 | B2 | 3/2004 | Dallmeyer et al. | |
| 6,811,091 | B2 | 11/2004 | Dallmeyer et al. | |
| 6,830,037 | B1 | 12/2004 | Braun et al. | |
| 6,840,226 | B2 | 1/2005 | Hans | |
| 6,848,477 | B2 | 2/2005 | Treusch et al. | |
| 6,851,631 | B2 * | 2/2005 | Dallmeyer et al. | 239/585.1 |
| 6,871,637 | B2 | 3/2005 | Tsuchiya et al. | |
| 6,877,484 | B2 | 4/2005 | Reiter | |
| 6,899,087 | B2 * | 5/2005 | Norgauer | 123/470 |
| 6,901,913 | B1 | 6/2005 | Tsuchiya et al. | |
| 6,921,033 | B2 | 7/2005 | Reiter | |
| 6,923,162 | B2 | 8/2005 | Reiter | |
| 6,925,989 | B2 | 8/2005 | Treusch et al. | |
| 6,988,681 | B2 | 1/2006 | Reiter | |
| 7,059,548 | B2 | 6/2006 | Reiter et al. | |
| 7,093,584 | B1 * | 8/2006 | Potter et al. | 123/447 |
| 7,107,969 | B2 | 9/2006 | Norcutt et al. | |
| 7,128,055 | B2 | 10/2006 | Zdroik | |
| 7,128,281 | B2 * | 10/2006 | Cho et al. | 239/585.1 |
| 7,258,287 | B2 | 8/2007 | Cho et al. | |
| 7,334,571 | B1 * | 2/2008 | Beardmore | 123/470 |
| 7,377,264 | B2 | 5/2008 | Buehner | |
| 7,406,946 | B1 * | 8/2008 | Watanabe et al. | 123/470 |
| 7,431,226 | B2 * | 10/2008 | Cho et al. | 239/585.1 |
| 7,527,038 | B2 * | 5/2009 | Watanabe et al. | 123/470 |
| 7,665,198 | B2 | 2/2010 | Cho et al. | |
| 7,931,007 | B2 | 4/2011 | Fischer et al. | |
| 2001/0032894 | A1 | 10/2001 | Perry | |
| 2002/0038650 | A1 | 4/2002 | Scollard et al. | |
| 2002/0084343 | A1 | 7/2002 | Dallmeyer et al. | |
| 2002/0088879 | A1 | 7/2002 | Dallmeyer et al. | |
| 2003/0010847 | A1 | 1/2003 | Curran et al. | |
| 2003/0094513 | A1 | 5/2003 | Luft | |
| 2004/0134550 | A1 | 7/2004 | Treusch et al. | |
| 2005/0045155 | A1 | 3/2005 | Harvey et al. | |
| 2005/0116056 | A1 | 6/2005 | Hans et al. | |
| 2005/0161025 | A1 | 7/2005 | Braun et al. | |
| 2005/0269426 | A1 * | 12/2005 | Cho | 239/533.2 |
| 2005/0269427 | A1 | 12/2005 | Cho | |
| 2005/0279328 | A1 | 12/2005 | Zdroik | |
| 2006/0065244 | A1 | 3/2006 | Norcutt et al. | |
| 2007/0113828 | A1 | 5/2007 | Fonville et al. | |
| 2007/0227984 | A1 * | 10/2007 | Wells et al. | 210/767 |
| 2008/0053409 | A1 | 3/2008 | Beardmore | |
| 2008/0105762 | A1 | 5/2008 | Cho et al. | |
| 2008/0264386 | A1 | 10/2008 | Watanabe et al. | |
| 2009/0229575 | A1 * | 9/2009 | Giorgetti et al. | 123/470 |
| 2009/0230677 | A1 * | 9/2009 | Mannucci et al. | 285/318 |

FOREIGN PATENT DOCUMENTS

| | | |
|---|---|---|
| DE | 19826011 | 12/1998 |
| EP | 0780569 | 6/1997 |
| EP | 0995902 | 4/2000 |
| EP | 1229239 | 8/2002 |
| EP | 1275841 | 1/2003 |
| EP | 1387942 | 2/2004 |
| EP | 1460262 | 9/2004 |
| JP | 8312491 | 11/1996 |
| WO | 0210583 | 2/2002 |
| WO | 02090757 | 11/2002 |
| WO | 2004083622 | 9/2004 |

OTHER PUBLICATIONS

"New Porsche 911 poised for a successful launch in North America", press release from Porsche AG dated Sep. 3, 2008, Statement of Relevance attached, 2 pages.

* cited by examiner

IN-LINE NOISE FILTERING DEVICE FOR FUEL SYSTEM

CROSS-REFERENCE TO RELATED APPLICATIONS

This application claims priority as a divisional of U.S. patent application Ser. No. 12/499,495, filed Jul. 8, 2009, now U.S. Pat. No. 7,942,132, which claims priority as a non-provisional of U.S. Provisional Patent Application No. 61/081,511 filed Jul. 17, 2008. The entire contents of both referenced applications are hereby incorporated by reference.

BACKGROUND

The present invention relates to fluid delivery systems, and more particularly, means for reducing injector-induced noise in a fuel-injected engine of an automobile.

A fuel injection system for an internal combustion engine can include a plurality of fuel injectors coupled to a fuel-distributor supply line or fuel rail. A receiving bore is formed in the cylinder head of the engine for each fuel injector in the case of a direct injection system. Each fuel injector is coupled to the fuel-distributor supply line to receive high pressure fuel therefrom. Each fuel injector is inserted into a solid pipe connection of the supply line and sealed with a sealing ring as shown in FIGS. 1-3 of U.S. patent application Ser. No. 11/922,525, the entire contents of which are hereby incorporated by reference.

During operation, hydraulic forces that are proportional to the cross-sectional area are generated with respect to the fuel injector and the supply line. These are transmitted to the engine structure in the form of structure-borne noise and thereby lead to undesired sound radiation.

SUMMARY

In one aspect, the invention provides a fuel injection system that includes a fuel supply rail having a supply opening. A fuel injector is coupled to the fuel supply rail and configured to control the delivery of fuel from the fuel supply rail through the supply opening. A noise filtering device engages an upstream end of the fuel injector. The noise filtering device has a projecting portion extending at least partially into the supply opening along an axis, and the noise filtering device defines a restriction passage for directing fuel from the supply rail into the fuel injector. A face seal is established at a transverse face adjacent the supply opening.

In another aspect, the invention provides a fuel injection system including a fuel supply rail, a fuel injector configured to control the delivery of fuel from the fuel supply rail, and a noise filtering device engaging an upstream end of the fuel injector. The noise filtering device defines a fuel passage configured to direct fuel from the fuel supply rail into the fuel injector. A pocket is defined within the noise filtering device. The pocket is remote from the fuel passage.

In yet another aspect, the invention provides a fuel injection system including a fuel supply rail, a fuel injector configured to control the delivery of fuel from the fuel supply rail, and a noise filtering device engaging an upstream end of the fuel injector. The noise filtering device defines a fuel passage configured to direct fuel from the fuel supply rail into the fuel injector. The noise filtering device wraps around an upstream end of the fuel injector, contacting an interior surface of the fuel injector, an upstream end surface of the fuel injector, and an exterior surface of the fuel injector.

In yet another aspect, the invention provides a fuel injection system including a fuel supply rail with a supply opening and a fuel injector coupled to the fuel supply rail at the supply opening and configured to control the delivery of fuel from the fuel supply rail. A fuel rail connector defines a substantially transverse face adjacent the supply opening, and at least a portion of the fuel injector is received within the fuel rail connector. A noise filtering device engages an upstream end of the fuel injector. The noise filtering device includes both a projecting portion extending at least partially into the supply opening and a face-sealing portion configured to abut the substantially transverse face to prevent fuel from filling the fuel rail connector.

In yet another aspect, the invention provides a fuel injection system including a fuel supply rail with a supply opening, a fuel injector coupled to the fuel supply rail at the supply opening and configured to control the delivery of fuel from the fuel supply rail, and a fuel rail connector. At least a portion of the fuel injector is received within the fuel rail connector. A noise filtering device is positioned at least partially within the fuel injector. The noise filtering device includes a plurality of parallel restriction passages.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
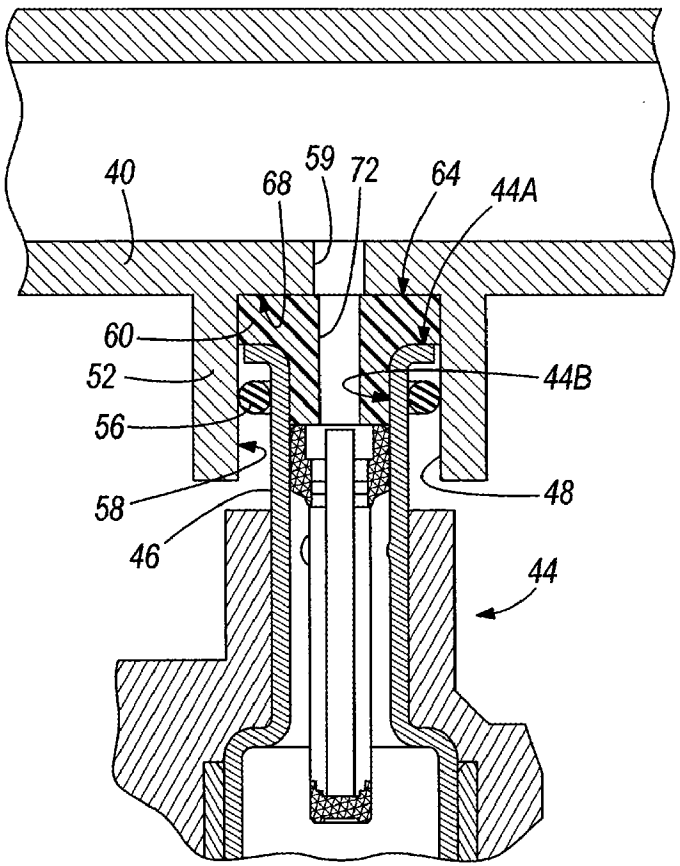
FIG. 1 is a cross-sectional view of a noise filtering device according to a first construction of the present invention.

FIG. 1 illustrates a portion of a fuel injection system for an internal combustion engine. The fuel injection system includes a fuel supply rail 40 and a plurality of fuel injectors 44 (only the upstream portion of one shown) coupled to the fuel supply rail 40. The fuel injection system can be configured as a direct-injection system in which pressurized fuel is supplied from a high pressure pump (not shown) directly into a combustion chamber of an engine. However, the invention described in detail below is also applicable to traditional (low pressure) port fuel injection systems as well as other types of hydraulic systems in which pressurized fluid is distributed with on/off valves. The fuel injector 44 of FIG. 1 has a plug-in arrangement with a feature of the fuel supply rail 40. As illustrated, an upstream portion of the fuel injector 44, including an inlet tube 46, fits snugly into a recess or bore 48 of a fuel rail connector 52 or "cup". The fuel injector 44 is pressed into the bore 48 with a sealing ring 56, such as an O-ring to ensure that fuel from the fuel supply rail and/or fuel vapor escapes only through the injectors 44. As illustrated, the sealing ring 56 is positioned just below (i.e., downstream of) a radially extending flange adjacent an upstream end surface 44A of the fuel injector 44 and is compressed in the space between the inlet tube 46 and the adjacent wall 58 of the fuel rail connector 52. An opening 59 provides fluid communication between the internal volume of the supply rail 40 and the fuel rail connector 52.

In addition to the sealing ring 56, each fuel injector 44 is fluidly coupled to the fuel supply rail 40 with an in-line noise filtering device 60. The fuel injection system without the noise filtering device 60 is susceptible to an audible "ticking" or "ringing" noise, particularly noticeable at engine idle speed in direct-injected engines (in which fuel is dispersed directly into the combustion chambers at high pressure). During operation, pressure pulsations in the fuel injection system are introduced by operation of the fuel pump and also by the opening and closing action of the fuel injectors 44. Pressure in the supply rail 40 varies relatively slowly by the buildup and reduction of pressure as a function of the driving states (e.g., about 50 bar at idle and about 200 bar at full-load). On the contrary, very dynamic pressure variation occurs at each triggered injection event due to the pressure waves inside the fuel injector 44 (e.g., 10 to 40 bar peak-to-peak amplitude).

The highly dynamic pressure variations triggered during the operation of the fuel injectors 44 produce strong alternating forces, which act on the supply rail 40 and fuel injectors 44. The low-frequency component (less than 1 kHz) can have a noticeable adverse effect on the sealing function of the sealing ring 56 in the fuel rail connector 52 and also on the sealing of the fuel injectors 44 with respect to the cylinder head/combustion chamber, due to the forced relative moments. The high-frequency component (about 1 kHz to about 5 kHz) is transferred to the entire engine structure, including the cylinder head, as structure-borne noise via fuel injectors 44 and supply rail 40, where it leads to sound radiation.

The noise filtering device 60 engages the upstream end of the fuel injector 44, and in the illustrated construction, is at least partially inserted into the inlet tube 46. The noise filtering device 60 of FIG. 1 at least partially wraps around the upstream end of the fuel injector 44, contacting the upstream end surface 44A and an interior surface 44B of the inlet tube 46 of the fuel injector 44. The noise filtering device 60 is substantially form-fitting with the fuel injector 44, following the contour of the upstream end portion of the fuel injector 44. The noise filtering device 60 can be constructed of a metal, an elastomer, or a combination of a metal and an elastomer, for example a metal sleeve inside an elastomeric capsule. In some constructions, the noise filtering device 60 may be constructed of an engineering plastic.

The noise filtering device 60 is "in-line" with the fuel injector 44, by which it is meant that the noise filtering device 60 provides the fluid connection between the supply rail 40 and the fuel injector 44 and/or the noise filtering device 60 defines a flow passage inside the fuel injector 44. The upstream end surface 44A of the fuel injector 44 and the fuel rail connector 52 are generally not exposed to fuel, and the noise filtering device 60 provides a direct fluid connection that routes fuel to the inlet of the fuel injector 44 from the internal volume of the supply rail 40. The noise filtering device 60 reduces the effective area under system pressure on the fuel injector 44 and minimizes the fuel volume of the fuel rail connector 52. As shown in FIG. 1, the noise filtering device 60 includes a face-sealing portion 64 configured to abut and form at least a partial seal with a face 68 of the fuel rail connector 52 that extends substantially transverse to the axial direction of the injector 44 and the connector 52 and is directly adjacent the opening 59. The noise filtering device 60 includes an opening or passage 72 that is in direct fluid communication with the opening 59 to route fuel from the supply rail 40 to the injector 44. Fuel pressure pulsations are lessened or prevented from propagating into the fuel rail connector 52 as fuel is at least partially blocked by the noise filtering device 60 from entering the fuel rail connector 52. Rather, the bulk of the delivered fuel is directly supplied from the supply rail 40, through the opening 59 to the fuel injector 44. The passage 72 can be, but need not be precisely sized or aligned with the opening 59 to the supply rail 40.

By way of the at least partial face seal provided by the noise filtering device 60, the sealing ring 56 serves as a secondary seal and is not required to bear the full sealing load. Also, because of the at least partial face seal between the noise filtering device 60 and the face 68, fuel pressure in the volume of the fuel rail connector 52 (between the noise filtering device 60 and the sealing ring 56) is reduced. Regardless of the sealing performance between the noise filtering device 60 and the face 68 of the fuel rail connector 52, the noise filtering device 60 prevents fuel from filling the fuel rail connector 52 by providing a direct path into the injector 44 and simply occupying a large amount of the volume within the fuel rail connector 52 that would otherwise be available to incoming fuel.

Figure 2:
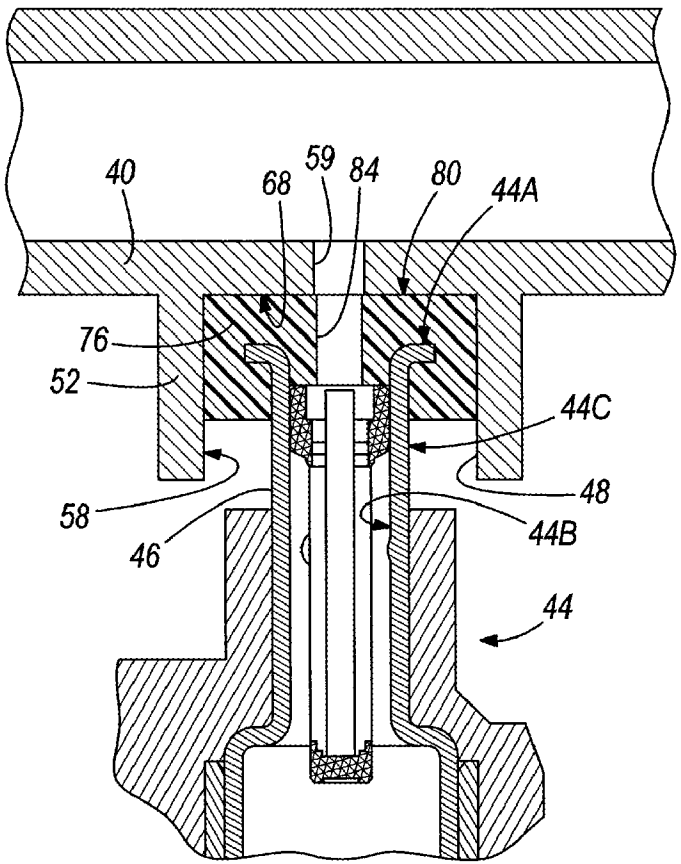
FIG. 2 is a cross-sectional view of a noise filtering device according to a second construction.

FIG. 2 illustrates a portion of a fuel injection system including a fuel supply rail 40, a fuel injector 44, and an alternate in-line noise filtering device 76, which is similar to the noise filtering device 60 shown in FIG. 1 in most respects. Therefore, reference is made to the above description for common features. Like the noise filtering device 60 shown in FIG. 1, the alternate noise filtering device 76 engages the upstream end of the fuel injector 44 and provides a direct fluid connection between the inlet of the fuel injector 44 and the internal volume of the supply rail 40. In the illustrated construction, the noise filtering device 76 is at least partially inserted into the inlet tube 46. The noise filtering device 76 of FIG. 2 wraps around the upstream end of the fuel injector 44, contacting the upstream end surface 44A, the interior surface 44B, and an exterior surface 44C of the inlet tube 46 of the fuel injector 44 as described in further detail below. The noise filtering device 76 is substantially form-fitting with the fuel injector 44, following the contour of the upstream portion of the fuel injector 44.

In some constructions, the noise filtering device 76 may be constructed of an engineering plastic. The noise filtering device 76 reduces the effective area under system pressure on the fuel injector 44 and minimizes the fuel volume of the fuel rail connector 52. As shown in FIG. 2, the noise filtering device 76 includes a face-sealing portion 80 configured to abut the face 68 of the fuel rail connector 52 that is directly adjacent the opening 59. The noise filtering device 76 includes an opening or passage 84 that is in direct fluid communication with the opening 59 to route fuel from the supply rail 40 to the injector 44. Fuel pressure pulsations do not propagate into the fuel rail connector 52 as fuel is blocked by the noise filtering device 76 from entering the fuel rail connector 52. Rather, fuel is directly supplied from the supply rail 40, through the opening 59 to the fuel injector 44. The passage 84 can be, but need not be precisely sized or aligned with the opening 59 to the supply rail 40.

With the noise filtering device 76, the sealing ring 56 (FIG. 1) is eliminated completely. The noise filtering device 76 serves as the seal between the fuel rail connector 52 and the fuel injector 44 and prevents fuel from filling the fuel rail connector 52 by forming a seal against the face 68. Contrary to the noise filtering device 60 of FIG. 1, the alternate noise filtering device 76 wraps around the entire upstream end of the fuel injector 44. As shown in FIG. 2, the noise filtering device 76 wraps over the upstream end from inside of the inlet tube 46 to an area between the inlet tube 46 and the adjacent wall 58 of the fuel rail connector 52. The noise filtering device 76 extends below (i.e., further in the downstream direction) the radially extending flange adjacent the upstream end surface 44A of the fuel injector 44. The noise filtering device 76 may be configured to be press fit into the fuel rail connector 52 to secure the fuel injector 44 to the supply rail 40, although additional securing means can be provided to fix the fuel injector 44 in place.

Figure 3:
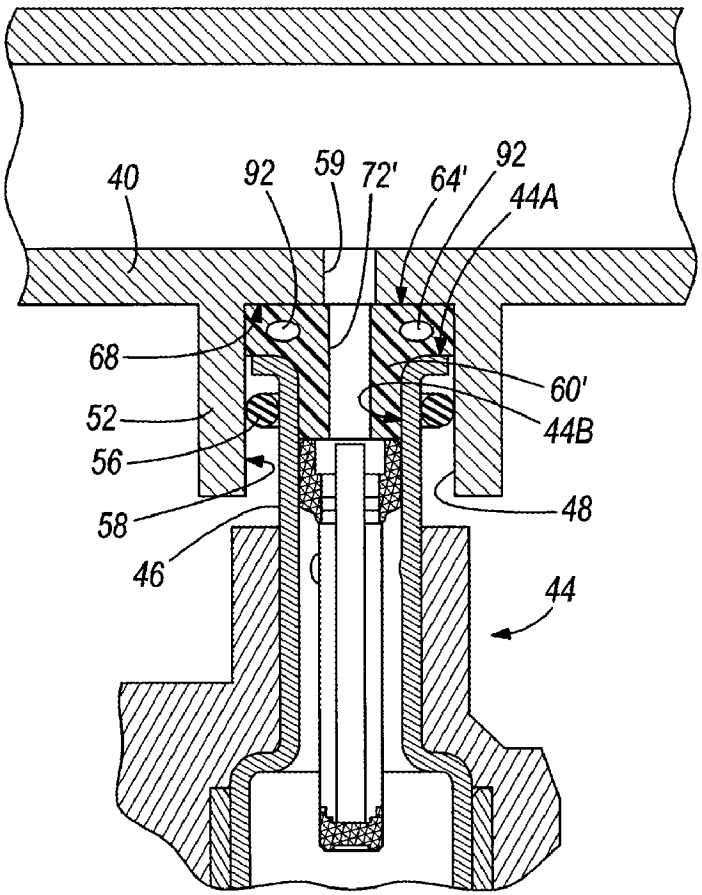
FIG. 3 is a cross-sectional view of a noise filtering device according to a third construction.

FIG. 3 illustrates a portion of a fuel injection system including a fuel supply rail 40, a fuel injector 44, and an alternate in-line noise filtering device 60', which is similar to the noise filtering device 60 shown in FIG. 1 in most respects. Therefore, reference is made to the above description for common features. Reference numbers referring to features of the noise filtering device 60' that are similar to that of the noise filtering device 60 of FIG. 1 are re-used in FIG. 3 and appended with an apostrophe. The difference in the noise filtering device 60' of FIG. 3 as compared to the noise filtering device 60 of FIG. 1 is the incorporation of one or more internal pockets 92. The noise filtering device 60' can, for example, include a single circumferentially-extending pocket, a single non-circumferentially-extending pocket, or a plurality of spaced-apart pockets. The pocket(s) 92 can contain air or another compressible fluid or substance configured to dampen pressure pulsations in the fuel injection system. In a high pressure application, the pockets(s) 92 can contain an incompressible fluid or substance. The dampening effect reduces or prevents the pressure pulsations from acting on the sealing ring 56 and the upstream end surface 44A of the fuel injector 44 to limit the forces that are applied to the fuel injector 44 (as well as the cylinder head to which the injector 44 is coupled), thus reducing noise produced by the fuel injection system.

Figure 4:
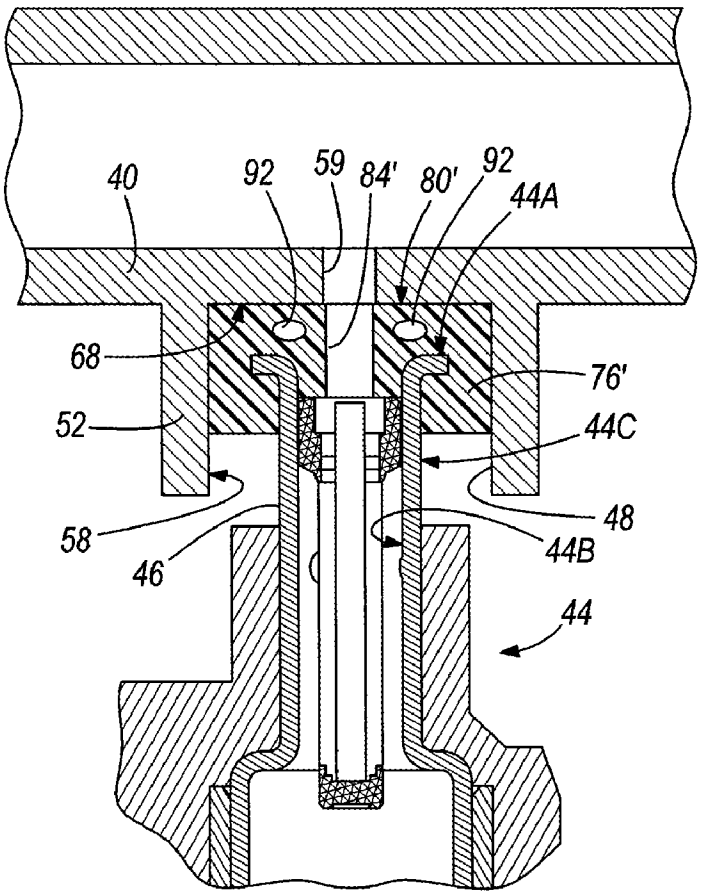
FIG. 4 is a cross-sectional view of a noise filtering device according to a fourth construction.

FIG. 4 illustrates a portion of a fuel injection system including a fuel supply rail 40, a fuel injector 44, and an alternate in-line noise filtering device 76', which is similar to the noise filtering device 76 shown in FIG. 2 in most respects. Therefore, reference is made to the above description for common features. Reference numbers referring to features of the noise filtering device 76' that are similar to that of the noise filtering device 76 of FIG. 2 are re-used in FIG. 4 and appended with an apostrophe. The difference in the noise filtering device 76' of FIG. 4 as compared to the noise filtering device 76 of FIG. 2 is the incorporation of one or more internal pockets 92, similar to the noise filtering device 60' of FIG. 3. The pocket(s) 92 can contain air or another compressible substance configured to dampen pressure pulsations in the fuel injection system. The dampening effect reduces or prevents the fuel pressure pulsations to limit the forces that are applied to the fuel injector 44 (as well as the cylinder head to which the injector 44 is coupled), thus reducing noise produced by the fuel injection system.

Figure 5:
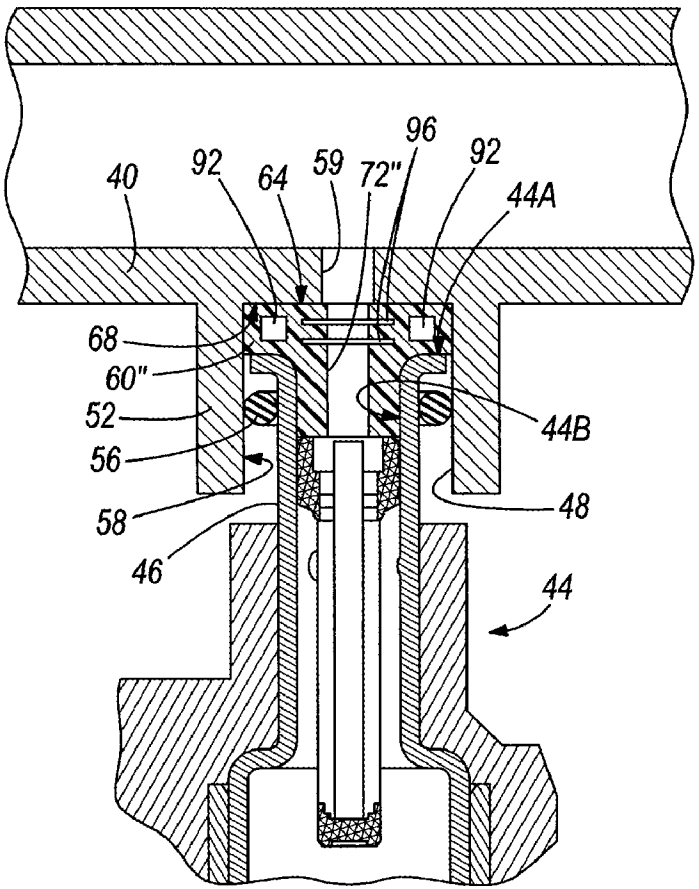
FIG. 5 is a cross-sectional view of a noise filtering device according to a fifth construction.

FIG. 5 illustrates a portion of a fuel injection system including a fuel supply rail 40, a fuel injector 44, and an alternate in-line noise filtering device 60", which is similar to the noise filtering device 60 shown in FIG. 1 in most respects. Therefore, reference is made to the above description for common features. Reference numbers referring to features of the noise filtering device 60" that are similar to that of the noise filtering device 60 of FIG. 1 are re-used in FIG. 5 and appended with two apostrophes. The difference in the noise filtering device 60" of FIG. 5 as compared to the noise filtering device 60 of FIG. 1 is the incorporation of one or more internal pockets 92 (as included in the noise filtering device 60' of FIG. 3) and one or more slits 96 adjacent to and in communication with the passage 72". In some constructions, the slits 96 extend circumferentially around the passage 72". As illustrated, the one or more pockets 92 are positioned radially outside a radially outermost end of the slits 96. The slits 96 accommodate a large range of compression due to a large axial clearance between the fuel injector 44 and the supply rail 40 by acting as self-energizing seals by the static pressure build-up and enable the noise filtering device 60" to filter noise generated by dynamic pressure pulsations. The noise filtering device 60" reduces or prevents the pressure pulsations from acting on the sealing ring 56 and the upstream end surface 44A of the fuel injector 44 to limit the forces that are applied to the fuel injector 44 (as well as the cylinder head to which the injector 44 is coupled), thus reducing noise produced by the fuel injection system.

Figure 6:
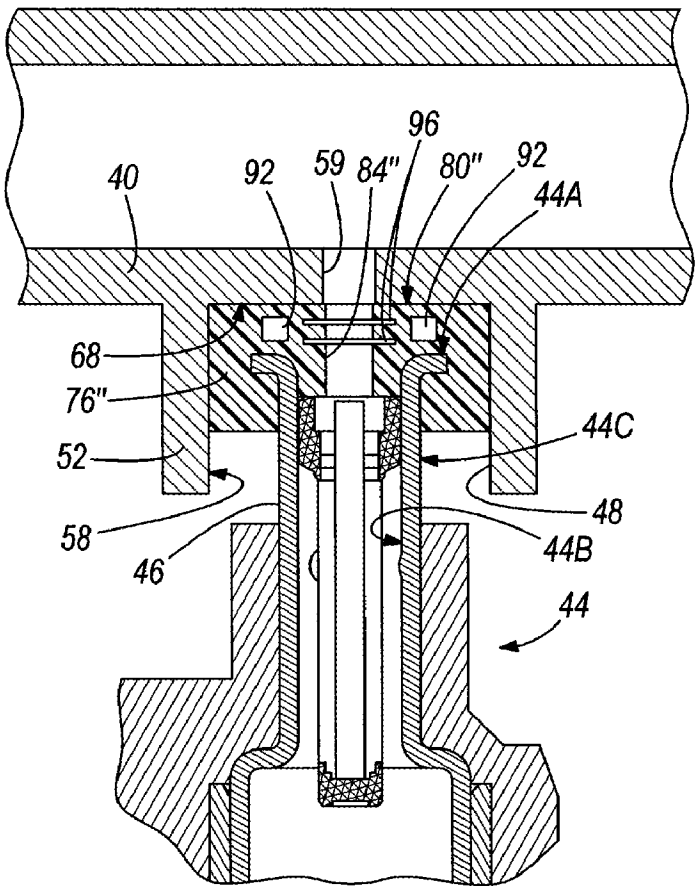
FIG. 6 is a cross-sectional view of a noise filtering device according to a sixth construction.

FIG. 6 illustrates a portion of a fuel injection system including a fuel supply rail 40, a fuel injector 44, and an alternate in-line noise filtering device 76", which is similar to the noise filtering device 76 shown in FIG. 2 in most respects.

Therefore, reference is made to the above description for common features. Reference numbers referring to features of the noise filtering device 76" that are similar to that of the noise filtering device 76 of FIG. 2 are re-used in FIG. 6 and appended with two apostrophes. The difference in the noise filtering device 76" of FIG. 6 as compared to the noise filtering device 76 of FIG. 2 is the incorporation of one or more internal pockets 92 (as included in the noise filtering device 76' of FIG. 4) and one or more slits 96 adjacent to and in communication with the passage 72". The slits 96 accommodate a large range of compression due to a large axial clearance between the fuel injector 44 and the supply rail 40 by acting as self-energizing seals by the static pressure build-up and enable the noise filtering device 76" to filter noise generated by dynamic pressure pulsations. The noise filtering device 76" reduces or prevents the pressure pulsations from acting on the fuel injector 44 to limit the forces that are applied to the fuel injector 44 (as well as the cylinder head to which the injector 44 is coupled), thus reducing noise produced by the fuel injection system.

Figure 7:
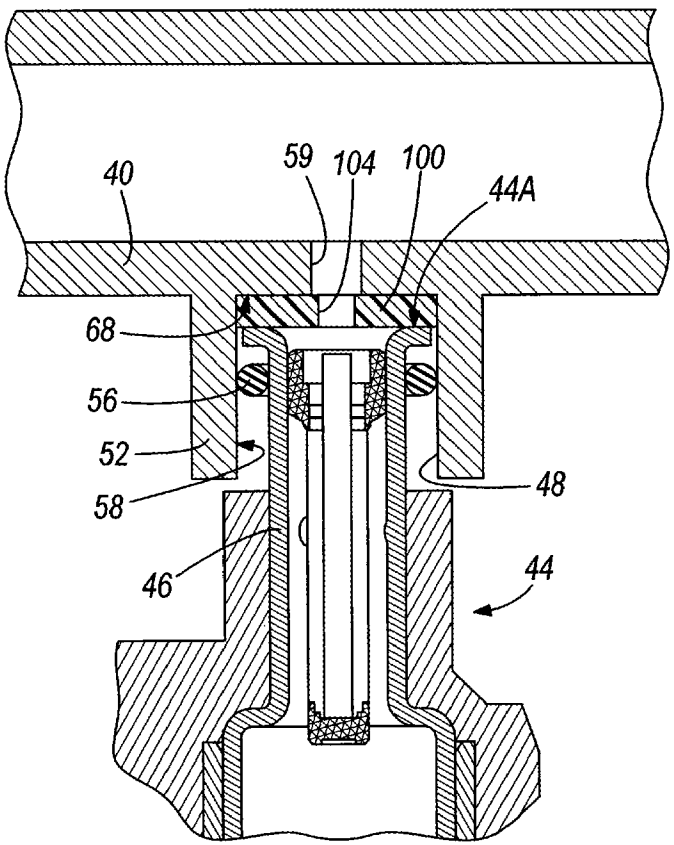
FIG. 7 is a cross-sectional view of a noise filtering device according to a seventh construction.

FIG. 7 illustrates a portion of a fuel injection system including a fuel supply rail 40, a fuel injector 44, and an in-line noise filtering device 100. The noise filtering device 100 engages the upstream end of the fuel injector 44, and more particularly rests on the upstream end surface 44A of the fuel injector 44. The noise filtering device 100 is generally disc-shaped and is configured to form at least a partial seal at the connection between the upstream end surface 44A of the fuel injector 44 and the face 68 of the fuel rail connector 52 that is directly adjacent the opening 59. The noise filtering device 100 may be constructed of an engineering plastic and includes an opening or passage 104 configured to be in direct fluid communication with the opening 59 to route fuel from the supply rail 40 to the injector 44. Although no portion of the noise filtering device 100 extends into the inlet tube 46 of the fuel injector 44, the passage 104 routes fuel from the fuel supply rail 40 into the fuel injector 44. The passage 104 can be, but need not be precisely sized or aligned with the opening 59 to the supply rail 40. In the illustrated construction, the passage 104 is generally aligned with the opening 59 and is slightly smaller in diameter than the opening 59. The noise filtering device 100 has an overall lateral dimension (measured side-to-side when viewing FIG. 7) that is about the same as the bore 48 in the fuel rail connector 52. Fuel pressure pulsations are lessened or prevented from propagating into the fuel rail connector 52 as fuel is at least partially blocked by the noise filtering device 100 from entering the fuel rail connector 52. Rather, the bulk of the delivered fuel is directly supplied from the supply rail 40, through the opening 59 to the fuel injector 44. The sealing ring 56 is maintained as shown in FIG. 7 as a secondary seal behind the at least partial face seal created by the noise filtering device 100. Regardless of the sealing performance between the noise filtering device 100 and the face 68 of the fuel rail connector 52, the noise filtering device 100 prevents fuel from filling the fuel rail connector 52 by providing a direct path into the injector 44 and simply occupying a large amount of the volume within the fuel rail connector 52 that would otherwise be available to incoming fuel. Making at least a partial face seal with the noise filtering device 100 against the face 68 reduces the effective area on top of the fuel injector 44 over which fuel pressure acts.

Figure 8:
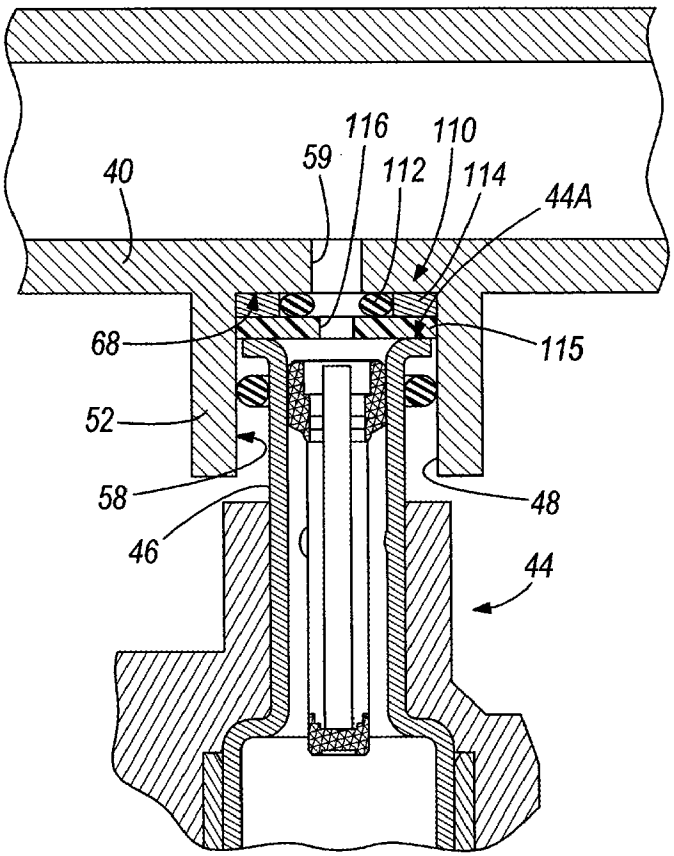
FIG. 8 is a cross-sectional view of a noise filtering device according to an eighth construction.

FIG. 8 illustrates a portion of a fuel injection system including a fuel supply rail 40, a fuel injector 44, and an in-line noise filtering device 110. The noise filtering device 110 engages the upstream end of the fuel injector 44, and more particularly rests on the upstream end surface 44A of the fuel injector 44. The noise filtering device 110 includes a sealing ring (i.e., O-ring 112), a back-up sealing element (i.e., flat sealing ring 114), and a retainer 115 that is sandwiched between the O-ring 112 and the flat sealing ring 114 on one side and the upstream end surface 44A of the fuel injector 44 on the opposite side. The O-ring 112 is configured to seal against the face 68 of the fuel rail connector 52 that is directly adjacent the opening 59. The flat sealing ring 114 is positioned adjacent and just radially outward of the O-ring 112 such that the O-ring 112 is radially supported by the flat sealing ring 114. The flat sealing ring 114 contacts the face 68 as well as the wall 58 of the fuel rail connector 52. The O-ring 112 is configured to contact the face 68 just radially outward of the opening 59 to prevent fuel from filling the volume of the fuel rail connector 52 and to keep the exposed cross-sectional area at the upstream end of the noise filtering device 110 low.

An opening 116 in the retainer 115 is substantially aligned with, but slightly smaller than the opening 59. Although no portion of the noise filtering device 110 extends into the inlet tube 46 of the fuel injector 44, the passage formed by the O-ring 112 and the opening 116 routes fuel directly from the fuel supply rail 40 into the fuel injector 44, preventing fuel from filling the fuel rail connector 52. Because of the positioning of the O-ring 112 in relation to the opening 116, the effective area of the upstream end of the fuel injector 44 subject to fuel pressure (constituted in this case by the exposed area on the upstream side of the retainer 115) is kept low. This reduces the effect of the dynamic pressure pulsations in the fuel, which is greatly responsible for introducing axial excitation on the fuel injector 44, which is transmitted to the engine absent the noise filtering device 110. The retainer 115, although illustrated as a thin, flat ring, may take alternate forms and may alternately be provided as an integral part of the fuel injector 44.

Figure 9:
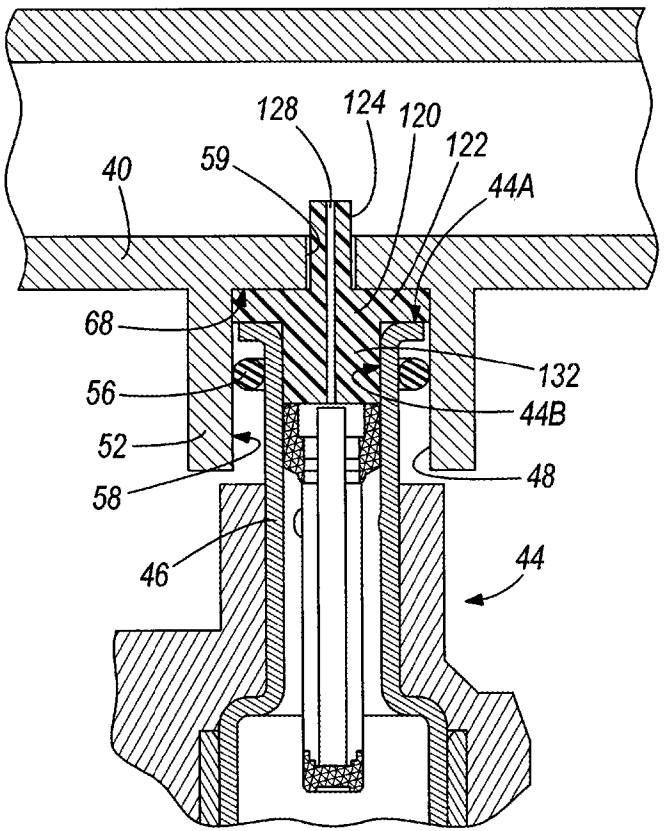
FIG. 9 is a cross-sectional view of a noise filtering device according to a ninth construction.

FIG. 9 illustrates a portion of a fuel injection system including a fuel supply rail 40, a fuel injector 44, and an in-line noise filtering device 120, which is similar to the noise filtering devices 60, 100 shown respectively in FIGS. 1 and 7 except as noted below. Reference is made to the above description for common features. The noise filtering device 120 includes a generally disc-shaped portion 122 similar to the noise filtering device 100 of FIG. 7 that extends to the wall 58 of the fuel rail connector 52 and is configured to form at least a partial seal against the face 68 of the fuel rail connector 52 that is directly adjacent the opening 59. The noise filtering device 120 further includes a projecting portion 124 that extends through the opening 59 and into the supply rail 40. The projecting portion 124 is sized to fit in the opening 59 with a small amount of clearance to allow assembly and disassembly. An opening or restriction passage 128 extends through the noise filtering device 120 to directly route fuel from the supply rail 40 to the injector 44. The restriction passage 128 has a cross-sectional area that is substantially less than that of the opening 59. In one construction, the restriction passage 128 has a diameter of about 0.6 millimeters and a length of about 10 millimeters. Opposite the projecting portion 124, an insertion portion 132 fits snugly inside the inlet tube 46 of the fuel injector 44. Fuel pressure pulsations are lessened or prevented from propagating into the fuel rail connector 52 as fuel is at least partially blocked by the noise filtering device 120 from entering the fuel rail connector 52. Rather, the bulk of the delivered fuel is directly supplied from the supply rail 40, through the restriction passage 128 in the noise filtering device 120 to the fuel injector 44. The small diameter of the passage 128 further restricts the transfer of fuel pressure pulsations through the fuel injector 44 without significantly reducing the output capacity of the fuel injector 44. The passage 128 is sized to maintain a discharge pressure of the fuel injector 44, which promotes good spray pattern and fuel atomization. The sealing ring 56 is maintained as shown in FIG. 9 as a secondary seal behind the at least partial seal created by the noise filtering device 120.

Figure 10:
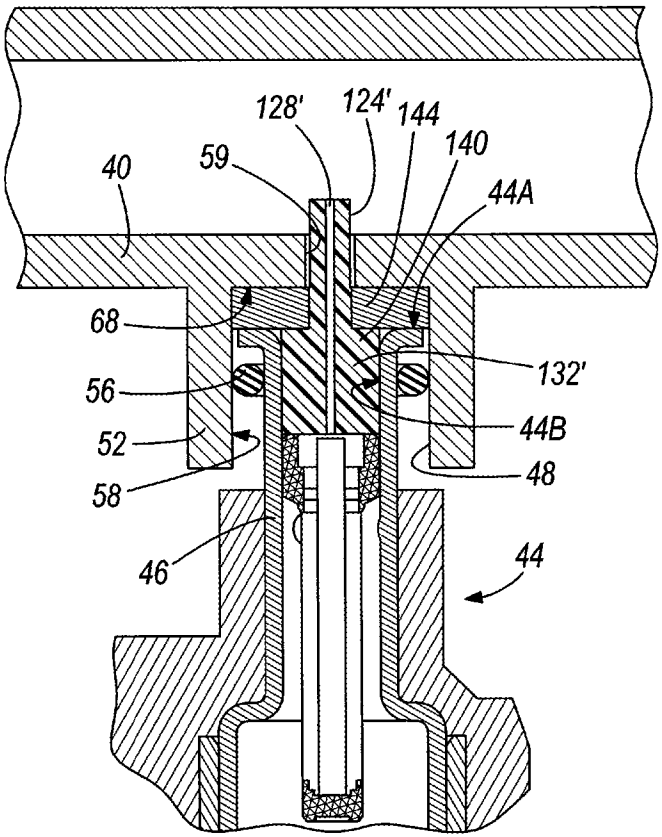
FIG. 10 is a cross-sectional view of a noise filtering device according to a tenth construction.

FIG. 10 illustrates a portion of a fuel injection system including a fuel supply rail 40, a fuel injector 44, and an in-line noise filtering device 140, which incorporates aspects of the noise filtering devices 110, 120 shown respectively in FIGS. 8 and 9. Reference is made to the above description for common features. The noise filtering device 140 is similar to the noise filtering device 120 of FIG. 9, except that it lacks the disc-shaped portion 122 that extends to the wall 58 of the fuel rail connector 52. Rather, a flat sealing ring 144 is provided around the noise filtering device 140. The noise filtering device 140 works with the sealing ring 144, which is similar to that of the noise filtering device 110 of FIG. 8 and is configured to form at least a partial seal against the face 68 of the fuel rail connector 52 and the wall 58 of the fuel rail connector 52. The noise filtering device 140 includes a projecting portion 124' that extends through the opening 59 and into the supply rail 40. The projecting portion 124' is sized to fit in the opening 59 with a small amount of clearance to allow assembly and disassembly. An opening or restriction passage 128' extends through the noise filtering device 140 to directly route fuel from the supply rail 40 to the injector 44. The restriction passage 128' has a cross-sectional area that is substantially reduced compared to the opening 59. In one construction, the restriction passage 128' has a diameter of about 0.6 millimeters and a length of about 10 millimeters. Opposite the projecting portion 124', an insertion portion 132' fits snugly inside the inlet tube 46 of the fuel injector 44. Fuel pressure pulsations are lessened or prevented from propagating into the fuel rail connector 52 as fuel is at least partially blocked by the sealing ring 144 from entering the fuel rail connector 52. Rather, the bulk of the delivered fuel is directly supplied from the supply rail 40, through the passage 128' in the noise filtering device 140, to the fuel injector 44. The small diameter of the passage 128' further restricts the transfer of fuel pressure pulsations through the fuel injector 44 while maintaining a required output capacity of the fuel injector 44. The passage 128' is sized to maintain a discharge pressure of the fuel injector 44, which promotes good spray pattern and fuel atomization. The sealing ring 56 is maintained as shown in FIG. 10 as a secondary seal behind the at least partial seal created by the sealing ring 148 of the noise filtering device 140.

Figure 11:
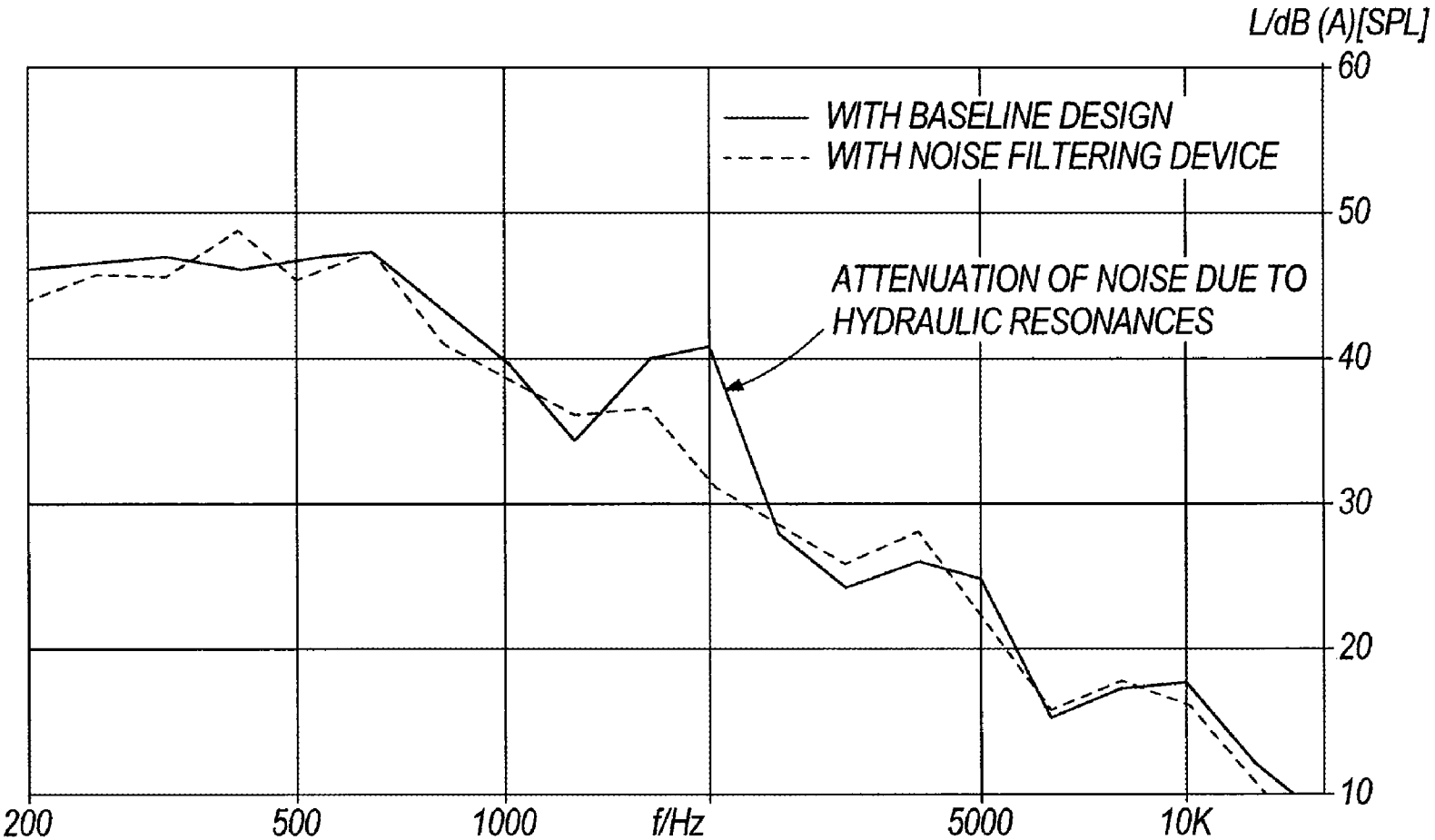
FIG. 11 is a graph representing the acoustic benefits of one of the noise filtering devices illustrated in FIGS. 9 and 10.

FIG. 11 graphically illustrates the effect of the invention as observed in an automobile from a driver's seat position (the automobile having a 4-cylinder engine with an undesirable sound level at about 2 kHz caused by the opening and closing of the fuel injector 44). FIG. 11 is a sound level versus frequency plot of the one-third octave band spectrum illustrating the reduction in sound pressure level around 2 kHz as provided by one of the noise filtering devices 120, 140. Other ones of the noise filtering devices described herein are also capable of achieving similar benefits.

Figure 13:
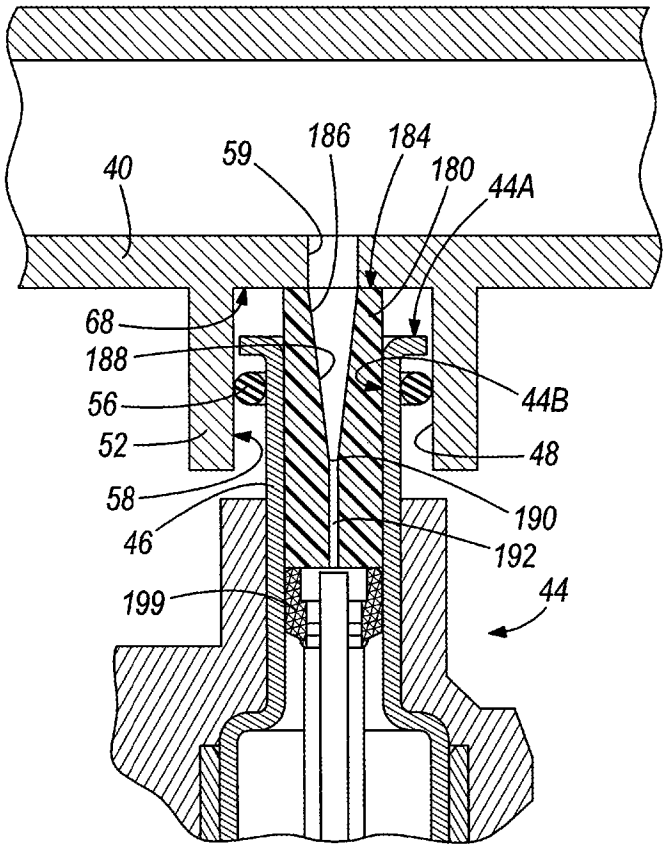
FIG. 13 is a cross-sectional view of a noise filtering device according to a twelfth construction.
Figure 12:
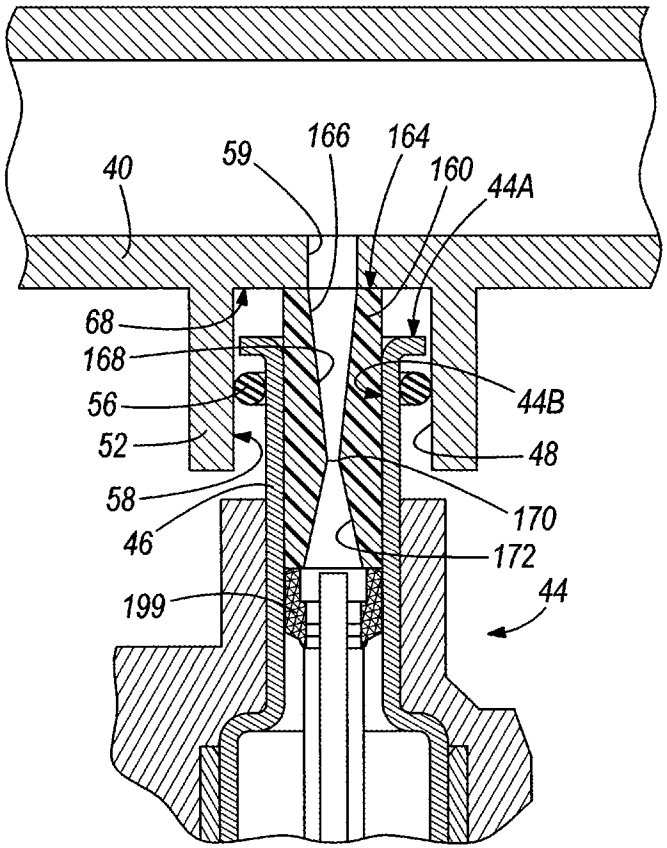
FIG. 12 is a cross-sectional view of a noise filtering device according to an eleventh construction.

FIGS. 12 and 13 illustrate portions of respective fuel injection systems, each including a fuel supply rail 40, a fuel injector 44, and respective in-line noise filtering devices 160, 180. Each of the noise filtering devices 160, 180 engages the upstream end of the respective fuel injector 44, for example, contacting the interior surface 44B of the inlet tube 46 at the upstream end. Each of the noise filtering devices 160, 180 includes a face-sealing portion 164, 184 configured to abut and form at least a partial seal with the face 68 of the fuel rail connector 52 directly adjacent the opening 59 to the supply rail 40. The noise filtering devices 160, 180 can be constructed of an engineering plastic. The sealing ring 56 is retained in both constructions (FIGS. 12 and 13) to firmly position the respective injectors 44 into the respective fuel rail connector bores 48, and also to serve as a secondary seal behind the at least partial seal between the noise filtering device 160, 180 and the face 68.

The noise filtering device 160 of FIG. 12 includes an opening or passage 166 that routes fuel directly from the fuel supply rail 40 into the fuel injector 44. The passage 166 includes a compression section 168 of decreasing cross-sectional area (in the direction of fuel outflow) that tapers to a minimum cross-sectional area neck portion 170. In one construction, the neck portion 170 has a diameter of about 0.6 millimeters. The neck portion 170 opens into an expansion section 172 of increasing cross-sectional area (in the direction of fuel outflow). The neck portion 170 provides a choking point that filters out fuel pressure pulsations while maintaining a required fuel delivery capacity of the fuel system. The neck portion 170 is sized to maintain a discharge pressure of the fuel injector 44, which promotes good spray pattern and fuel atomization. Thus, the noise filtering device 160 of FIG. 12 provides a combination of improved flow benefit and noise-vibration-harshness (NVH) benefit.

The noise filtering device 180 of FIG. 13 includes an opening or passage 186 that routes fuel directly from the fuel supply rail 40 into the fuel injector 44. The passage 186 includes a compression section 188 of decreasing cross-sectional area (in the direction of fuel outflow) that leads to a neck portion 190 where the passage 186 transitions to a restriction passage 192 of constant, reduced cross-sectional area. In one construction, the restriction passage 192 has a diameter of about 0.6 millimeters and a length of about 5 millimeters. The neck portion and restriction passage 190, 192 provide a choking effect that filters out fuel pressure pulsations while maintaining a required fuel delivery capacity of the fuel system. The neck portion and restriction passage 190, 192 are sized to maintain a discharge pressure of the fuel injector 44, which promotes good spray pattern and fuel atomization.

Both of the noise filtering devices 160, 180 of FIGS. 12 and 13 are of significant length (e.g., about 12 millimeters), engaging the upstream ends of the respective fuel injectors 44, but also extending deeply into the inlet tubes 46 of the respective fuel injectors 44. In each of the fuel injectors 44 illustrated in FIGS. 12 and 13, an internal particulate filter 199 is relocated from the upstream end to a more downstream location within the fuel injector 44. Because the noise filtering devices 160, 180 of FIGS. 12 and 13 are pressed into the inlet tubes 46 of the respective fuel injectors along a majority of their lengths, hoop stresses in the noise filtering devices 160, 180 are negligible as the inlet tubes 46 provide ample support in the radial direction. Furthermore, because neither of the noise filtering devices 160, 180 of FIGS. 12 and 13 are configured to project through the opening 59, assembly and disassembly of the fuel injector 44 with the supply rail 40 is made easy without holding extremely tight alignment tolerances between the noise filtering devices 160, 180 and the respective openings 59. The noise filtering devices 160, 180 are not particularly susceptible to becoming damaged when the fuel injector 44 is pressed into and/or pulled out of the fuel rail connector 52.

Figure 15:
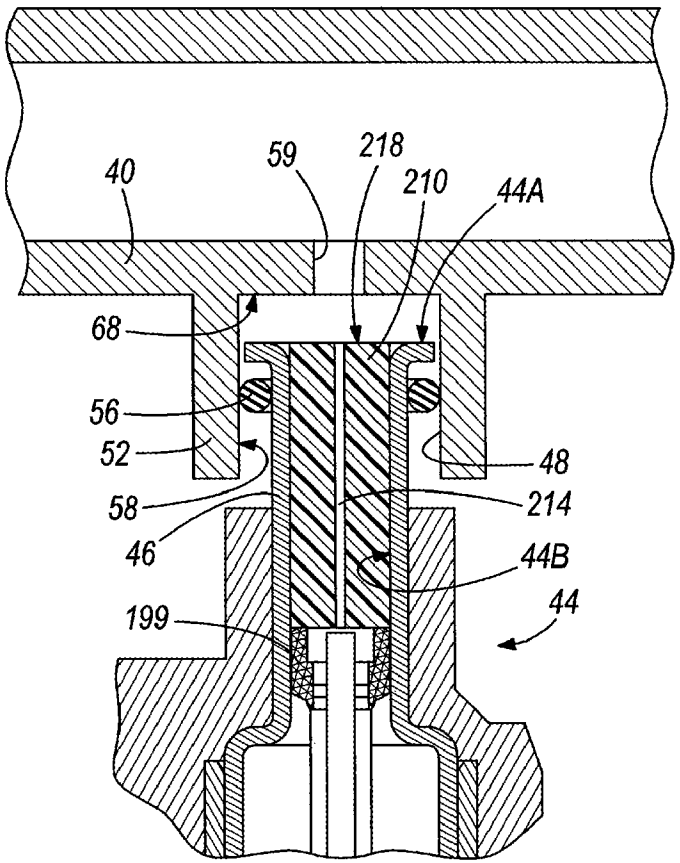
FIG. 15 is a cross-sectional view of a noise filtering device according to a fourteenth construction.
Figure 14:
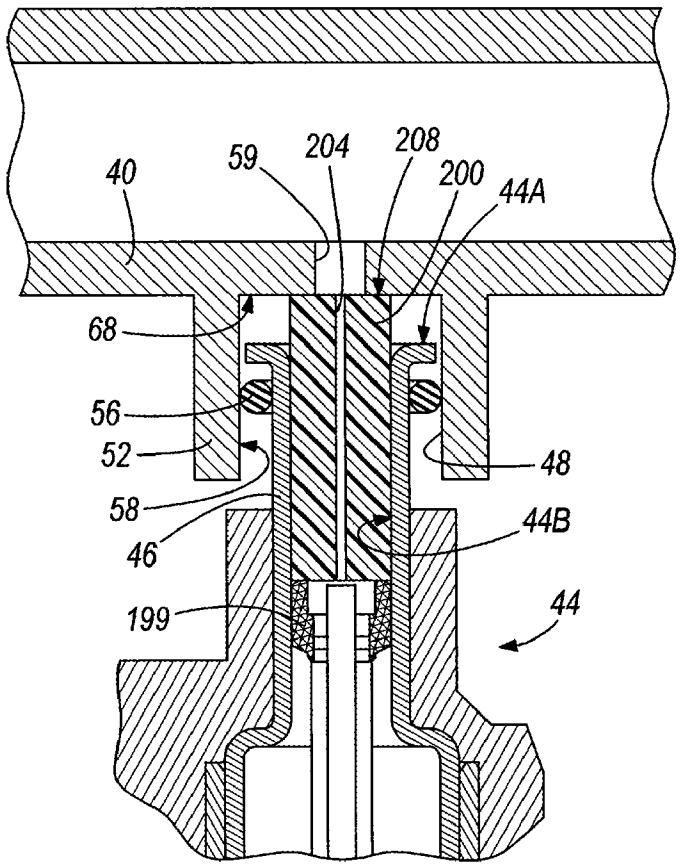
FIG. 14 is a cross-sectional view of a noise filtering device according to a thirteenth construction.

FIGS. 14 and 15 illustrate portions of respective fuel injection systems, each including a fuel supply rail 40, a fuel injector 44, and respective in-line noise filtering devices 200, 210. Similar to the noise filtering devices 160, 180 of FIGS. 12 and 13, the noise filtering devices 200, 210 engage the upstream ends of the respective fuel injectors 44, but also extend deeply into the inlet tubes 46 of the respective fuel injectors 44. The noise filtering devices 200, 210 include respective openings or restriction passages 204, 214 therethrough that route fuel directly into the respective fuel injectors 44. In one construction, the restriction passages 204, 214 have diameters of about 0.6 millimeters and lengths of about 12 millimeters. The noise filtering device 200 of FIG. 14 includes a face sealing portion 208 that abuts and forms at least a partial seal with the face 68 of the fuel rail connector 52 adjacent the opening 59. Fuel pressure pulsations are lessened or prevented from propagating into the fuel rail connector 52 as fuel is at least partially blocked by the noise filtering device 200 from entering the fuel rail connector 52. Rather, the bulk of the delivered fuel is directly supplied from the supply rail 40, through the opening 59 to the fuel injector 44. Although the noise filtering device 200 at least partially prevents fuel from entering the volume of the fuel rail connector 52, the sealing ring 56 is retained as a secondary seal behind the at least partial seal of the noise filtering device 200. Although the noise filtering device 200 extends outward of the inlet tube 46 past the upstream end surface 44A of the fuel injector 44, a large portion of the noise filtering device 200 is positioned inside the inlet tube 46.

The noise filtering device 210 of FIG. 15 includes an upstream end face 218 that does not extend past the upstream end surface 44A of the fuel injector 44 and instead, is substantially fully enclosed within the inlet tube 46. However, the noise filtering device 210 and the restriction passage 214 therethrough, are located directly in-line with the flow of fuel through the fuel injector 44 that is supplied from the fuel supply rail 40. Fuel from the supply rail 40 is permitted to enter the fuel rail connector 52 and relies upon the sealing ring 56 to retain fuel and fuel vapor. The internal filters 199 of the fuel injectors 44 of FIGS. 14 and 15 are located downstream of the upstream end, just downstream of the respective noise filtering devices 200, 210. The restriction passages 204, 214 of the noise filtering devices 200, 210 shown in FIGS. 14 and 15 are substantially smaller in cross-sectional area than the opening 59 to the fuel supply rail 40. Thus, pulsations in fuel pressure from the fuel injectors 44 are filtered and prevented from inducing undesirable noise while maintaining a required fuel supplying capacity of the fuel injectors 44. The restriction passages 204, 214 are sized to maintain a discharge pressure of the fuel injector 44, which promotes good spray pattern and fuel atomization.

Figure 17:
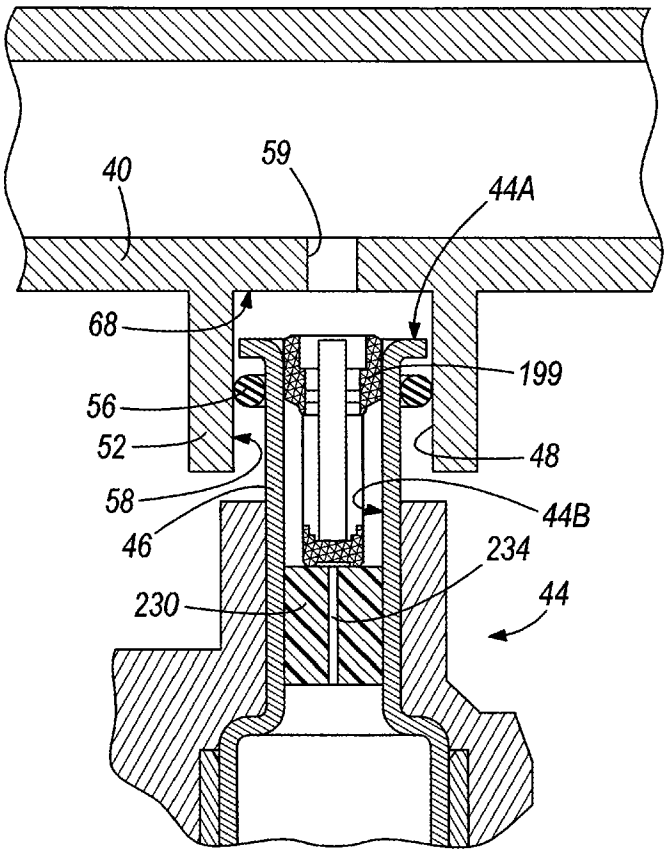
FIG. 17 is a cross-sectional view of a noise filtering device according to a sixteenth construction
Figure 16:
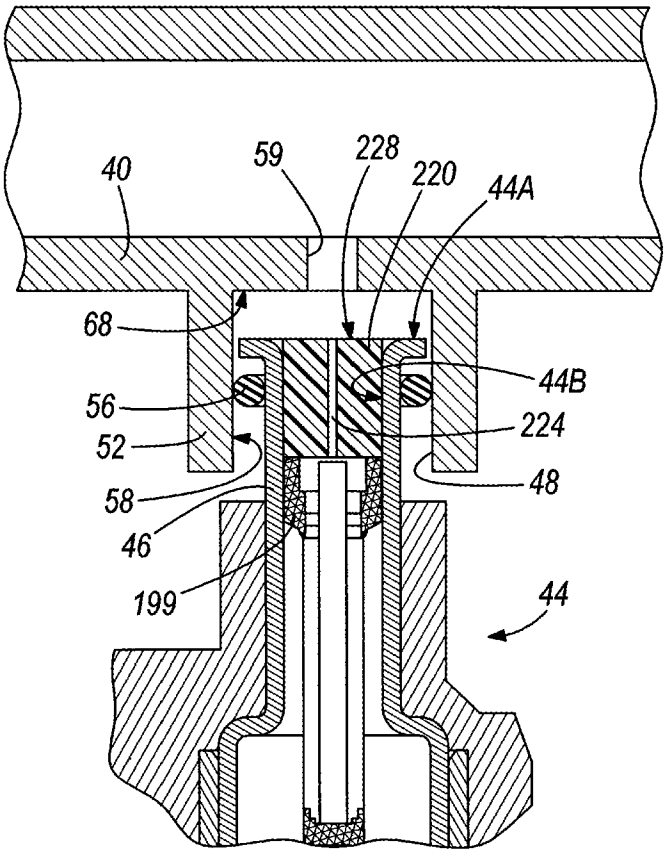
FIG. 16 is a cross-sectional view of a noise filtering device according to a fifteenth construction.

FIGS. 16 and 17 illustrate portions of respective fuel injection systems, each including a fuel supply rail 40, a fuel injector 44, and respective in-line noise filtering devices 220, 230. The noise filtering devices 220, 230 include respective openings or restriction passages 224, 234 therethrough. In one construction, the restriction passages 224, 234 have diameters of about 0.6 millimeters and lengths of about 6 millimeters. The noise filtering devices 220, 230 are shaped similarly to the noise filtering devices 200, 210 of FIGS. 14 and 15 with the exception of being substantially shorter in length. The noise filtering device 220 of FIG. 16 engages the upstream end of the fuel injector 44 and includes an upstream end face 228 that does not extend substantially past the upstream end surface 44A of the fuel injector 44, while the noise filtering device 230 of FIG. 17 engages the fuel injector 44 at a location spaced downstream from the upstream end of the fuel injector 44. Thus, both noise filtering devices 220, 230 of FIGS. 16 and 17 are substantially fully enclosed within the respective inlet tubes 46. This allows fuel from the supply rail 40 to enter the fuel rail connector 52 and relies upon the sealing ring 56 to retain fuel and fuel vapor. However, the noise filtering devices 220, 230 and the restriction passages 224, 234 therethrough, are located directly in-line with the flow of fuel through the respective fuel injectors 44. The noise filtering devices 220, 230 of FIGS. 16 and 17 are located at two distinct locations, but may be relocated to virtually any location along the main flow passage of the fuel injector 44. Furthermore, the noise filtering devices 220, 230 may integrate the particulate filter 199 as a single piece therewith to reduce the component count and simplify assembly.

Figure 22:
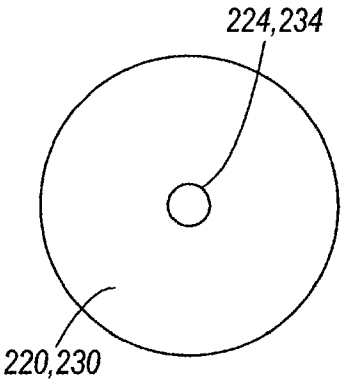
FIG. 22 is an axial end view of the noise filtering device of FIG. 16 or FIG. 17.

The restriction passages 224, 234 of the noise filtering devices 220, 230 shown in FIGS. 16 and 17 are substantially smaller in cross-sectional area than the opening 59 to the fuel supply rail 40. Thus, pulsations in fuel pressure from the fuel injectors 44 are filtered and prevented from inducing undesirable noise while maintaining a required fuel supplying capacity of the fuel injectors 44. The restriction passages 224, 234 are sized to maintain a discharge pressure of the fuel injector 44, which promotes good spray pattern and fuel atomization. FIG. 22 is an axial end view of one of the noise filtering devices 220, 230, which are identical when removed from the fuel injector 44. The internal filter 199 of the fuel injector 44 of FIG. 16 is located downstream of the upstream end, just downstream of the noise filtering device 220. The internal filter 199 of the fuel injector 44 of FIG. 17 is located at the upstream end, upstream of the noise filtering device 230. The internal filter 199 is a wire mesh filter in some constructions and traps minute particulate matter in the fuel to prevent the restriction passage 234 from becoming clogged.

Figure 18:
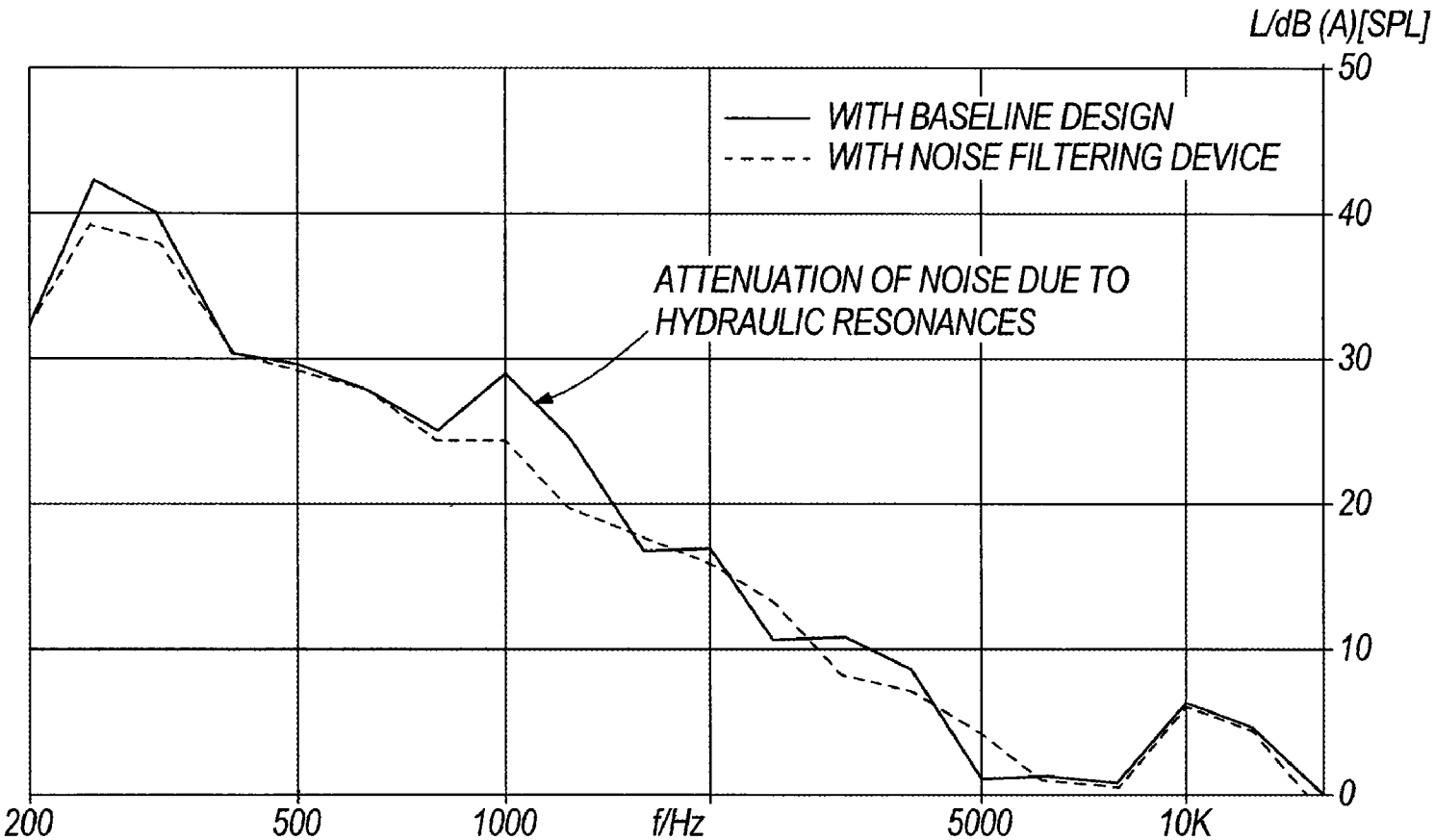
FIG. 18 is a graph representing the acoustic benefits of the noise filtering device illustrated in FIG. 16.

FIG. 18 is similar to FIG. 11 and graphically illustrates the effect of the invention as observed in an automobile from a driver's seat position (the automobile having a V-6 engine with an undesirable sound level at about 1 kHz caused by the opening and closing of the fuel injector 44). FIG. 18 is a sound level versus frequency plot of the one-third octave band spectrum illustrating the reduction in sound pressure level around 1 kHz as provided by the noise filtering device 220. Other ones of the noise filtering devices described herein are also capable of achieving similar benefits.

Figure 19:
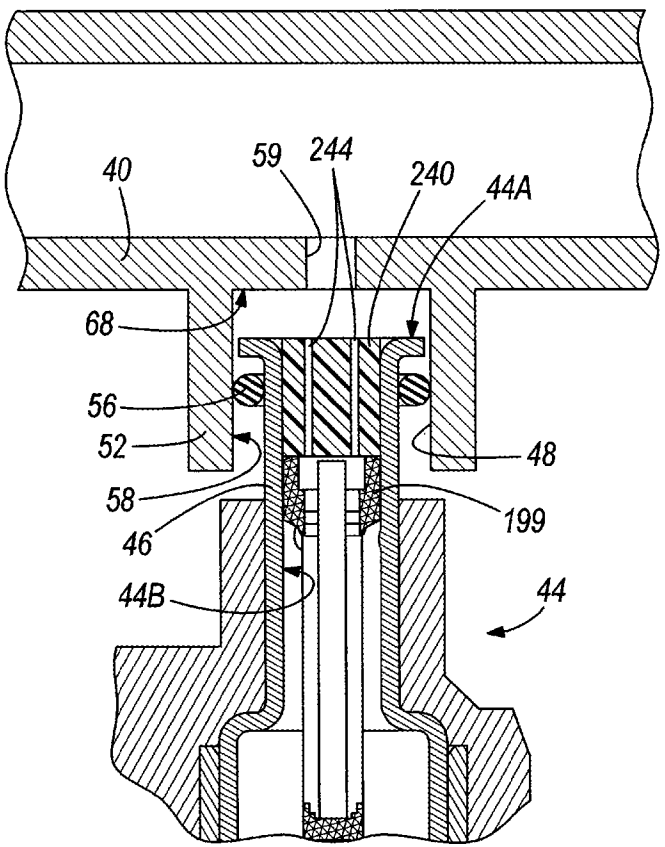
FIG. 19 is a cross-sectional view of a noise filtering device according to a seventeenth construction.
Figure 23A:
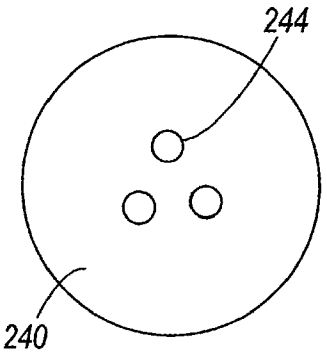
FIGS. 23A-23C are axial end views of the noise filtering device of FIG. 19, illustrating optional hole patterns for a plurality of restriction passages.
Figure 23B:
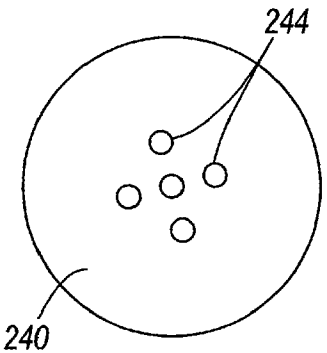
Figure 23C:
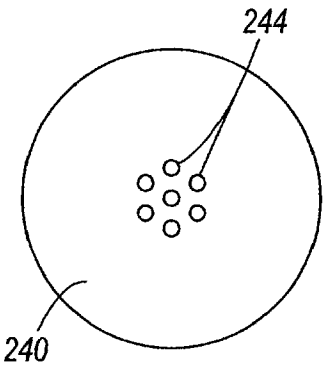

FIG. 19 illustrates a portion of a fuel injection system including a fuel supply rail 40, a fuel injector 44, and an in-line noise filtering device 240, which is nearly identical to the noise filtering device 220 of FIG. 16. Therefore, reference is made to the above description for common features. The only difference between the noise filtering devices 220, 240 of FIGS. 16 and 19 is that the device 240 of FIG. 19 includes a plurality of openings or restriction passages 244, whereas the device 220 of FIG. 16 includes a single restriction passage 224. In some constructions, each of the restriction passages 244 has a diameter of about 0.6 millimeters and a length of about 6 millimeters. The restriction passages 244 may be three in number, arranged in a triangular pattern (as viewed from the upstream or downstream ends as shown in FIG. 23A), but other numbers and arrangements can be used. In some constructions, the noise filtering device 240 includes between 3 and 7 restriction passages, all of which are in parallel flow with each other. FIGS. 23B and 23C illustrate the noise filtering device 240 with 5 and 7 restriction passages 244, respectively. When the number of restriction passages 244 is increased, the diameter of the passages 244 can be decreased to maintain a substantially equal cross-sectional area as a noise filtering device 240 having fewer restriction passages 244, or alternately, the increase in the number of restriction passages 244 can be used to increase the total flow capacity by providing additional cross-sectional area. As an alternative to providing a plurality of small passages, the noise filtering device 240 can be constructed of a porous material such as sintered bronze or densely packed wire mesh.

The restriction passages 244 are sized to maintain a discharge pressure of the fuel injector 44, which promotes good spray pattern and fuel atomization. The concept of including a plurality of openings or restriction passages as embodied in the noise filtering device 240 of FIG. 19 can be combined with many of the features shown in FIGS. 1-10 by keeping the respective openings or passages very small. For example, the noise filtering device 240 may contact the face 68 of the fuel rail connector 52 to make a full or partial fluid seal therewith. Likewise, other examples of the noise filtering devices disclosed herein can be modified to include multiple restriction passages where only one is shown.

Figure 20:
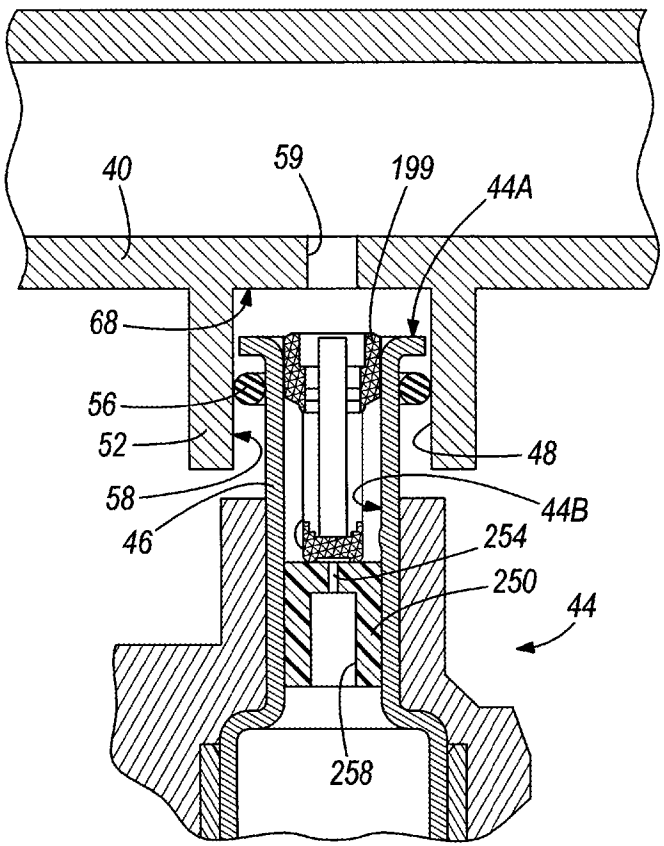
FIG. 20 is a cross-sectional view of a noise filtering device according to an eighteenth construction.
Figure 21:
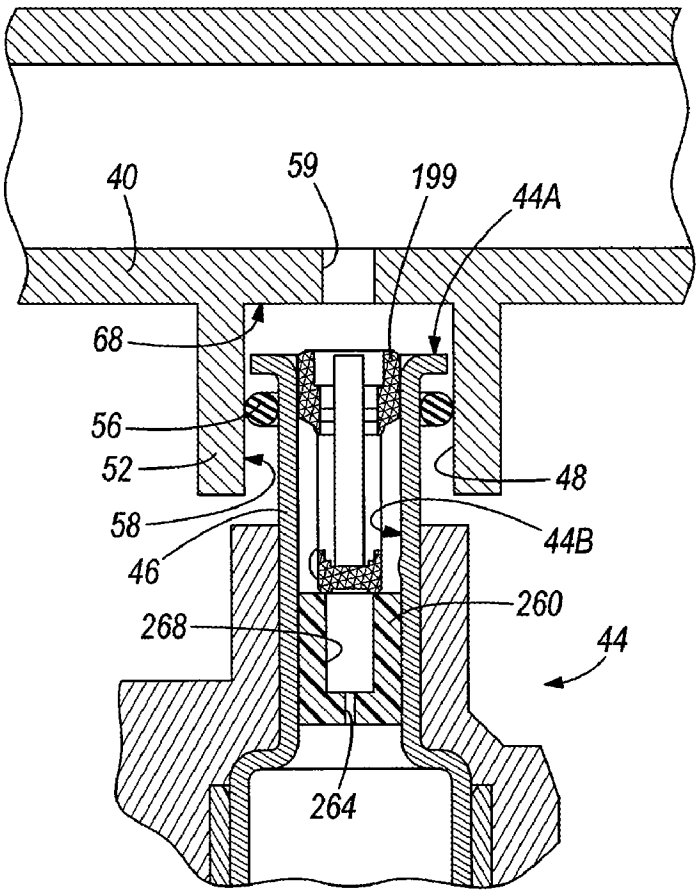
FIG. 21 is a cross-sectional view of a noise filtering device according to a nineteenth construction.

FIGS. 20 and 21 illustrate portions of fuel injection systems, each including a fuel supply rail 40, a fuel injector 44, and respective in-line noise filtering devices 250, 260, which are nearly identical to the noise filtering device 230 of FIG. 17. Therefore, reference is made to the above description for common features. The only difference between the noise filtering devices 250, 260 of FIGS. 20 and 21 as compared to the device 230 of FIG. 17 is that the devices 250, 260 of FIGS. 20 and 21 include restriction passages 254, 264 having shorter lengths (e.g., about 1-2 millimeters) and connect to large cross-section passages 258, 268 (e.g., about 2 millimeters in diameter). The short-length restriction passages 254, 264 provide pressure pulsation filtering effects with less resistance to flow as compared to the restriction passage 234 of the noise filtering device 230 of FIG. 17, for example. The restriction passages 254, 264 are sized to maintain a discharge pressure of the fuel injector 44, which promotes good spray pattern and fuel atomization. In the noise filtering device 250 of FIG. 20, the large cross-section passage 258 is downstream of the restriction passage 254. In the noise filtering device 260 of FIG. 21, the large cross-section passage 268 is upstream of the restriction passage 264.

What is claimed is:

1. A fuel injection system comprising:

a fuel supply rail having a supply opening;

a fuel injector coupled to the fuel supply rail at the supply opening and configured to control the delivery of fuel from the fuel supply rail;

a fuel rail connector defining a substantially transverse face adjacent the supply opening, at least a portion of the fuel injector being received within the fuel rail connector; and a noise filtering device engaging an upstream end of the fuel injector, the noise filtering device including a projecting portion extending at least partially into the supply opening, and a face-sealing portion configured to abut the substantially transverse face to prevent fuel from filling the fuel rail connector.

2. The fuel injection system of claim 1, wherein the projecting portion extends through the supply opening and into the supply rail.

3. The fuel injection system of claim 1, wherein the projecting portion defines a restriction passage establishing the sole path of fluid communication between the supply rail and the fuel injector.

4. The fuel injection system of claim 3, wherein the restriction passage has a diameter of about 0.6 millimeters.

5. The fuel injection system of claim 4, wherein the restriction passage has a length of about 10 millimeters.

6. The fuel injection system of claim 1, wherein the projecting portion has a clearance fit into the supply opening.

7. The fuel injection system of claim 1, wherein the fuel injector includes an inlet tube, and the noise filtering device includes an insertion portion remote from the projecting portion, the insertion portion being pressed into the inlet tube.

8. The fuel injection system of claim 1, wherein the face-sealing portion is disc-shaped.

9. A fuel injection system comprising:

a fuel supply rail having a supply opening;

a fuel injector coupled to the fuel supply rail and configured to control the delivery of fuel from the fuel supply rail through the supply opening;

a noise filtering device engaging an upstream end of the fuel injector, the noise filtering device having a projecting portion extending at least partially into the supply opening along an axis, and wherein the noise filtering device defines a restriction passage for directing fuel from the supply rail into the fuel injector; and a face seal established at a transverse face adjacent the supply opening.

10. The fuel injection system of claim 9, wherein the projecting portion extends through the supply opening and into the supply rail.

11. The fuel injection system of claim 9, wherein the restriction passage establishes the sole path of fluid communication between the supply rail and the fuel injector.

12. The fuel injection system of claim 11, wherein the restriction passage has a diameter of about 0.6 millimeters.

13. The fuel injection system of claim 12, wherein the restriction passage has a length of about 10 millimeters.

14. The fuel injection system of claim 9, wherein the projecting portion has a clearance fit into the supply opening.

15. The fuel injection system of claim 9, wherein the fuel injector includes an inlet tube, and the noise filtering device includes an insertion portion remote from the projecting portion, the insertion portion being pressed into the inlet tube.

16. The fuel injection system of claim 9, wherein the transverse face forms part of a fuel rail connector that receives an upstream portion of the fuel injector.

17. The fuel injection system of claim 9, wherein the face seal is established between the transverse face and a disc-shaped portion of the noise filtering device.

18. The fuel injection system of claim 9, wherein the face seal is established between the transverse face and a sealing ring that is positioned around the noise filtering device.

* * * * *